US008007412B2

(12) United States Patent
Lofgren et al.

(10) Patent No.: US 8,007,412 B2
(45) Date of Patent: Aug. 30, 2011

(54) BICYCLING EXERCISE APPARATUS

(76) Inventors: Michael Shane Lofgren, Tualatin, OR (US); Brian Charles Stewart, Oregon City, OR (US); John Jeremiah Harrington, Los Angeles, CA (US)

( * ) Notice: Subject to any disclaimer, the term of this patent is extended or adjusted under 35 U.S.C. 154(b) by 241 days.

(21) Appl. No.: 12/406,106

(22) Filed: Apr. 9, 2009

(65) Prior Publication Data

US 2009/0253558 A1 Oct. 8, 2009

Related U.S. Application Data

(62) Division of application No. 10/904,785, filed on Nov. 29, 2004, now Pat. No. 7,530,932.

(51) Int. Cl.
*A63B 22/06* (2006.01)

(52) U.S. Cl. ..... 482/62; 74/143

(58) Field of Classification Search ..... 482/52, 482/56, 57, 61, 62, 72, 92, 114, 118, 119, 482/51, 63; 280/242.1, 250, 253; 434/61; 74/143, 594.1, 594.3
See application file for complete search history.

(56) References Cited

U.S. PATENT DOCUMENTS

| | | | | |
|---|---|---|---|---|
| 4,423,863 | A * | 1/1984 | Figueroa | 482/62 |
| 5,338,272 | A * | 8/1994 | Sweeney, III | 482/57 |
| 5,580,338 | A * | 12/1996 | Scelta et al. | 482/62 |
| 5,860,329 | A * | 1/1999 | Day | 74/594.1 |
| 6,287,239 | B1 * | 9/2001 | Hernandez | 482/1 |

* cited by examiner

*Primary Examiner* — Loan Thanh
*Assistant Examiner* — Tam Nguyen

(57) ABSTRACT

A method for doing an upper body spinning exercise whereby the operator rotates hand pedals attached to crank arms resulting in the spinning of a wheel for the purpose of exercising the upper body. This may be done in a class or group setting under the direction of an instructor and may be done to the accompaniment of music or verbal direction. The rotation of the wheel may be resisted by a friction or magnetic device and each crank arm engages the wheel independently of the other crank arm such that the operator can pedal with one hand while the other hand rests. The operator may also rotate each pedal at a different cadence than the other pedal. The operator may rotate the pedals such that the orientation of the crank arms is 180 degrees apart, 90 relative to each other or any angle of separation relative to each other.

12 Claims, 11 Drawing Sheets

BICYCLING EXERCISE APPARATUS

This application is a divisional of Ser. No. 10/904,785 filed Nov. 29, 2004, now U.S. Pat. No. 7,530,932.

BACKGROUND OF THE INVENTION

1. Field of the Invention

The present invention relates generally to the field of exercise equipment, and more specifically to exercise apparatus for aerobic, strength, and cardio vascular conditioning that permits a user to perform an upper body spinning bike exercise.

2. Description of the Related Art

Cardio-pulmonary, cardiovascular, and strength training exercise equipment found in today's exercise and health centers as well as in the home seek to improve and maintain an individual's aerobic and strength fitness. Many types of exercise equipment, including treadmills, rowing machines, stationary bicycles, stair-stepping machines, skiing machines (cross country and alpine), and dry-land swimming machines are available for individuals who desire to maintain and improve their overall fitness and conditioning.

Stationary bicycles provide users a means for exercising certain muscles, generally involving the legs, and to a much lesser extent, if any, the center core, i.e. abdominal and lower torso muscles that help cyclists balance, arms and upper body muscles, i.e. biceps, triceps, lateral oblique muscles and back muscles. The present invention in particular is directed at the spinning segment of the exercise market. A spinning bike is a stationary exercise bike that includes a frame, a seat, handlebars, pedals, and a large flywheel with a large moment of inertia. The large fly wheel is very important because it smoothes out the user's pedaling action and makes the stationary exercise bike feel like a conventional bicycle feels when ridden on the road. Spinning bikes prior to the present invention have been directed exclusively at the rider's lower body. Some stationary bicycles combine pedaling features that allow the rider to exercise both the legs and arms but these bikes are not suited for a spinning class setting and are never used in such a setting. The present invention is directed at spinning and spinning class settings and is specifically configured for upper body spinning. Some combined leg and upper body cycles allow for pedaling by the arms in a reciprocating manner where the hands engage pedals and turn both cranks in a reciprocating manner where the respective crank arms are locked in a fixed orientation such that as one crank arm is coming up and over the rotation the other side crank arm is rotating under and back toward the rider in a reciprocating motion. Other combined cycles have long lever arms attached to the wheel that the operator moves back and forth as in the Schwinn "Aerodyne". In the Schwinn Aerodyne the lever arms are directly connected to the foot pedals such that the rider may either rotate the foot pedals to rotate the wheel or lever the cranks or both efforts combined. These devices provide resistance to the arms and cardiovascular conditioning to the rider but the fixed orientation of the cranks in a reciprocating rotary motion prohibit the rider from establishing a spinning rhythm with the upper body. These combined devices also involve the use of the rider's legs as well as arms and result in an unpleasant and awkward motion or movement of the entire body. This combination of upper and lower body movement is not desirable to participants in a spinning class or in a spinning situation. The rider is confined to a sometimes boring left right, left right motion of the hands, arms and upper body.

The present invention allows the rider to use each hand and arm independently of the other; the rider can pedal with only one hand, both hands in tandem orientation, both hands in opposed or reciprocating orientation as in the Miller design or any combination or orientation. The rider can rotate one crank rapidly while letting the other pause similar to a boxer who jabs with his left hand quickly and repeatedly while his right hand is held back waiting; or the rider, using the present invention in an upper body "spinning class", who can move his arms and upper body in a dancing or rhythmic motion to music or instruction. The combined foot and arm powered design of Miller allows the rider to exercise at his discretion either the rider's legs or the rider's arms but does not allow the rider to alternately and independently exercise each arm irrespective of the other arm while maintaining contact with the hand pedals. The present invention is specifically addressed to allow the user to comfortably exercise his upper body in a spinning class setting without involving his legs.

There exists devices used for rehabilitation that utilize hand cranks and these devices are generally referred to as "UBE"'s for upper body exercisers. These devices are often mounted on stands or attached to walls and people, sometimes in wheelchairs, approach the "UBE" and pedal the cranks for exercise or rehabilitation. These machines use very small fly wheels weighing ten or twelve pounds of small moment of inertia and use a magnetic resistance to resist the user's pedaling motion. These machines also have both cranks in a locked or fixed orientation relative to each other such that the operator uses one arm or both but the operator cannot use both pedals independently of each other; that is the operator either pedals with both arms in a reciprocating manner or only with one arm at a time if it is desirable not to move the other arm. The crank arms could be mounted in either a tandem or side by side orientation or in an opposed or reciprocation orientation and each arm is locked in position relative to the other, but the present state of the art among "UBE's" does not provide a machine with the crank arms such that they can be moved independently of each other in an infinite array of orientations. This is because no one has yet to recognize the need for this type of motion except for the present invention and in the environment of a health club setting and in a spinning class where the operation of the machine is done to instruction or to music and the user needs free movement of both arms and the upper body.

The current state of stationary bicycle designs have typically been limited to designs that affix a pair of handlebars, pedals, and seat to a single rigid platform, e.g. bolted in place and resting on a floor, configured to replicate only the spinning dynamic associated with pedaling a bicycle. In this arrangement, current designs are able to exercise only the legs and hips and to a very small extent the upper body. These bikes are often used in class settings where an instructor with the accompaniment of music directs the riders for a period of time for the purpose of cardio conditioning through the use of mostly the operator's legs and hips. This is know as "spinning" and is now a world wide activity that involves hundreds of thousands of devotees. The present invention is intended to address this vast audience and allow them to have the same experience with their upper bodies and arms that they have heretofore only been able to experience with their legs and hips. The present invention would often times be used in a class setting adjacent to "conventional" "spinning bikes" that exercise only the legs and hips. The present design is not intended to be limited to only this type of setting but would be a tremendously appreciated addition to spinning classes and would allow the participants to develop their upper bodies to the same level of conditioning as their lower bodies.

The inability of today's stationary, leg actuated, "spinning bike" designs to involve the upper body, also limits the number and type of muscle groups involved. These designs do not engage many of the muscles in the upper body such as the back, arms, shoulders, nor do such stationary bikes address certain core muscles in the rider's trunk and oblique muscles. Such stationary bicycles can be considered undesirable and generally inadequate for training by cycling enthusiasts that want to develop their core and upper body while receiving cardio vascular conditioning.

Historically, cycling has not been thought of as a means of exercising the upper body. The development of the handcycle, although mostly thought of as a cycle for the disabled, has increased awareness in the cycling community of the benefits of cycling with the arms to develop the upper body and there has been significant cross over from disabled hand cyclists to able bodied hand cyclists. This awareness of hand cycling among the able bodied is creating a desire for upper body spinning bikes just as bicycling has caused an interest in stationary "spinning bikes" that condition and develop the lower body. These "spinning bikes" are generally but not exclusively used in a class setting. The present invention is ideally suited to be an adjunct to this "spinning class" setting.

UBE's as mentioned above are generally intended for disabled individuals seated in wheelchairs and lack a seat associated with the drive unit and wheel. Because the operator is seated in a wheelchair there is neither need for the exercise apparatus to have provisions structured to support the operator's feet not a seat to support the operator.

A major reason for the lack of popularity of this type of exercise apparatus is the lack of accommodation for an able-bodied operator and the perception because of the lack of seat and foot supports that this type of apparatus is designed to be used by the disabled. These machines also lack a large enough flywheel to provide the feeling of riding a handcycle on the road the way a large flywheel provides the feeling or riding a conventional spinning bike on the road. Also, because this type of device is not designed to be used by able-bodied operators, UBE's do not appear in a "spinning class" setting but are often limited to an obscure location in a fitness facility if at all; or in a rehab facility.

Current stationary bicycle designs tend to be relatively limited in that the user can only exercise his legs and only incidentally any of the muscle groups of the upper body and arms. The only significant dynamic interaction with the apparatus occurs at the pedals, limiting the exercise stimulation to the lower body during the pedaling action of the riding experience. Such designs are limited in the muscle groups involved and the quality of the upper body exercise that the spinning action may be produce. Users of such devices would likely be interested in an apparatus that stimulates the upper body during the cycling experience and users would likely desire to obtain the benefits of engaging a broader range of the muscle groups of the upper body as produced when using an upper body spinning device as opposed to a conventional stationary exercise spinning bike.

It would therefore be beneficial to provide an exercise apparatus that more accurately simulates the operation of a hand cycle and provides an opportunity to exercise the upper body while in a "spinning class" situation and overcome the limitations found in current stationary "spinning bike" designs which only provide an opportunity to exercise the legs.

SUMMARY OF THE INVENTION

According to one aspect of the present design there is provided an apparatus that allows the user to perform an upper body spinning exercise. The design includes a frame with a wheel mounted to the frame configured to be rotatably connected to a drive unit and the drive unit is configured to include crank arms enabling the operator to impart rotation of the wheel by pedaling the hand pedals. The drive unit may be further configured to allow pedaling of each crank arm independently of the other to enhance the upper body spinning experience. Wider or narrower crank arms may be provided to enable the rider to vary the muscle groups used during the spinning activity and further enhance the muscle development associated with the spinning experience. A foot platform may be added to support the user's feet providing an anchor point for the user's body to further enhance the upper body spinning experience.

These and other advantages of the present invention will become apparent to those skilled in the art from the following detailed description of the invention and the accompanying drawings.

DESCRIPTION OF THE FIGURES

The present invention is illustrated by way of example, and not by way of limitation, in the figures of the accompanying drawings in which.

DETAILED DESCRIPTION OF THE INVENTION

The present design is a stationary upper body exercise apparatus, typically comprising a frame and components, i.e. pedals, crank arms, seat, chain drive and flywheel, affixed to a stationary frame typically positioned on a smooth surface, e.g. hardwood or concrete floor enabling a the operator to exercise his upper body in a similar manner to the operator of a stationary "spinning bike" configured to exercise the rider's legs but in the case of this invention configured to exercise the operator's upper body including the arms, upper and lower back and abdominals in a spinning type activity.

In essence, the present design allows the operator to carry out a spinning activity for the upper body by pedaling hand pedals which are attached to the distal end of crank arms resulting in the rotation of a large flywheel in an effort to develop upper body strength and cardiovascular conditioning.

In addition, the present design may include wide or narrow crank arms attached to the drive unit enabling the operator to exercise different muscle groups. The present design may include cranks that are as much as 26 inches wide from pedal to pedal enabling the operator to exercise his outer pectoral muscles and upper back and traps or the bike may include conventional bicycle crank arms that are narrow and place the operator's grip on the pedals approximately seventeen inches apart enabling the operator to exercise his inner pectoral muscles and his biceps, triceps and deltoids. Any configuration of the pedals and crank arm widths enables the operator to exercise his upper body and some configurations of the pedals and crank arms may exercise some muscle groups more directly than other configurations.

The upper body spinning bike apparatus may include a drive unit that enables the operator to pedal each crank arm independently of the other crank arm enabling the operator to participate in a class setting under the direction of a class instructor. In this embodiment of the present design the operator may pedal several revolutions of one crank arm while the other crank arm is at rest and the switch to the other crank arm while the first arm rests. The crank arms may be configured through the drive unit to impart rotation to a flywheel enabling the operator to affect a smooth pedaling motion maintained by the flywheel. The upper body apparatus may include a friction device configured to apply resistance to the flywheel to simulate climbing a hill on the exercise device. The friction device may be configured to be adjustable by the operator and enable the operator to vary the resistance of the friction device being applied to the flywheel by a control device. The control device may be accessible to the operator when seated in the seat of the exercise apparatus.

Apparatus

Figure 1:
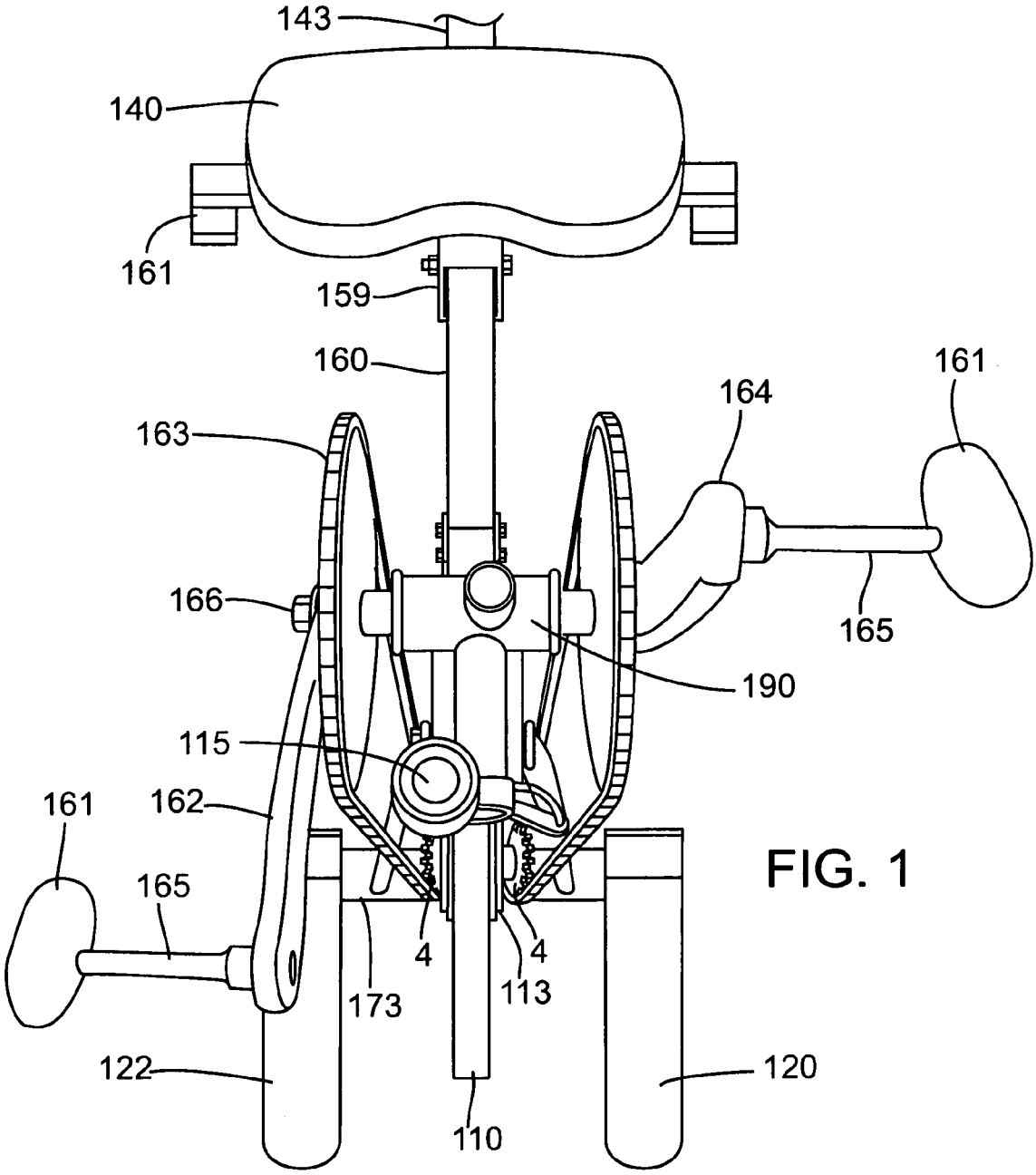
FIG. 1 is a top view depicting the independent crank arms with dual sprockets and chains; the right side crank arm and chain connected to the flywheel with a right hand freewheel clutch and the left side crank arm connected to the flywheel with a left-hand freewheel clutch; a flywheel tension knob is also shown.
Figure 2:
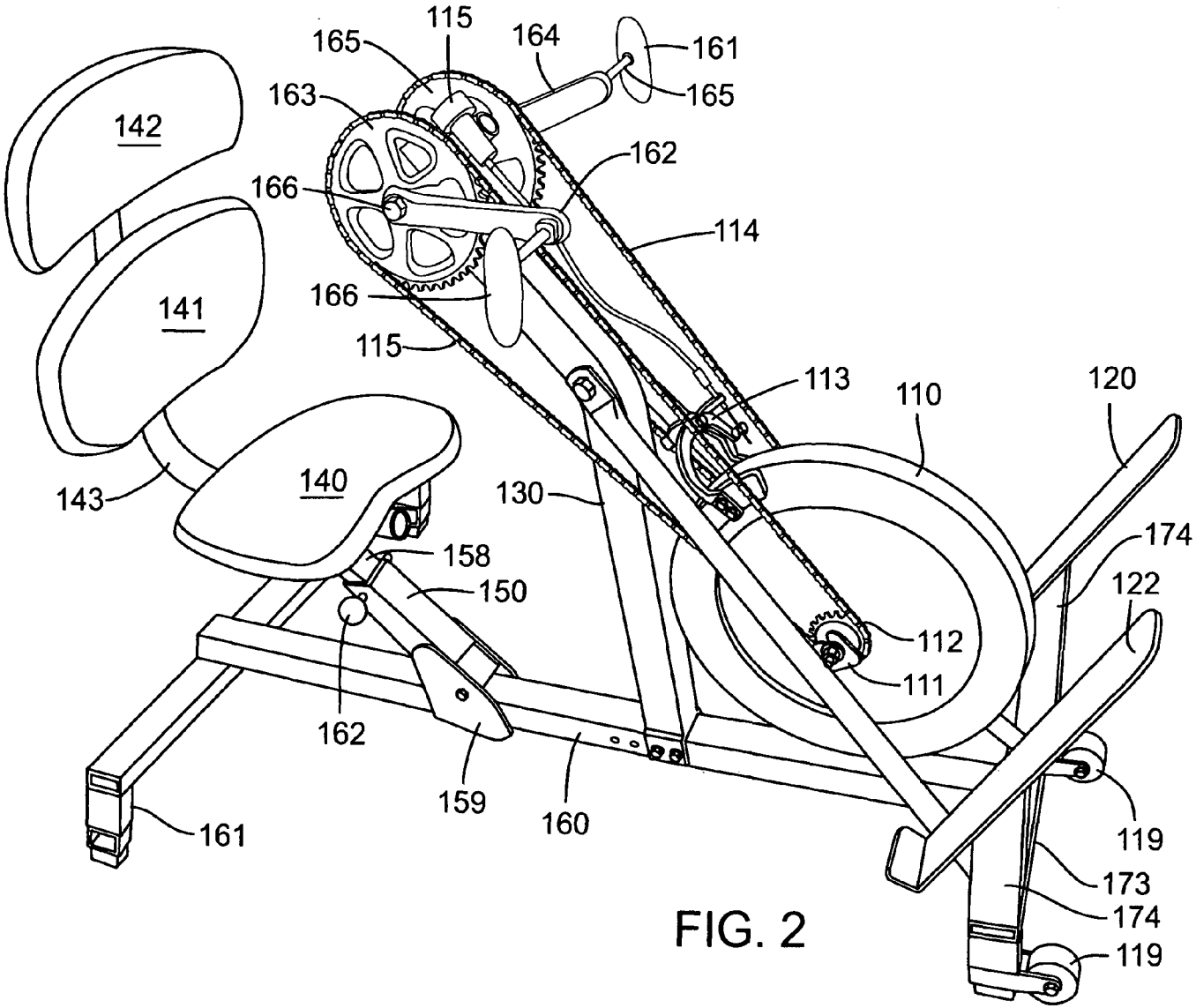
FIG. 2 is a perspective view of the upper body spinning bike depicting the independent crank arms and dual chains connecting each crank arm independently to a freewheel on each side of the flywheel; the left side chain in connected to the flywheel by means of a left hand freewheel and the right side crank arm is connected to the flywheel by means of a right hand freewheel.

The upper body spinning exercise apparatus is illustrated in FIGS. 1 and 2. In combination, these figures depict relationships between major assemblies and subassemblies of one embodiment of the present design.

FIG. 2 is a right hand side perspective view illustrating one aspect of the present design. Referring to FIG. 1, an upper body exercise apparatus 100 may include a stationary frame 160 arranged to support the user.

The bicycling exercise apparatus may include a variety of off-the-shelf parts, i.e. components, elements, devices, and combinations of individual components, to form sub-assemblies and complete assemblies used in constructing the present design. For example, the present design may include, and will be described for purposes of this disclosure, a stationary frame 160, chain 114, and seating assembly 140. Driveline and seating assemblies are generally known, and, for example, the driveline may be chain or belt driven or otherwise designed to effectuate the functionality described herein.

In general, the construction of the upper body exercise apparatus 100 is typically from metals, with other parts and components made from a variety of common materials, including but not limited to, aluminum alloys, carbon fiber, titanium, steel, composite materials, plastic, and wood and any combination thereof, to provide the functionality disclosed herein. Other materials may be employed in order to manufacture the parts and components to form assemblies used to construct the upper body exercise apparatus in accordance with the present design.

From FIG. 2, the present design's frame 160 may be constructed of multiple sections of formed steel. Although the construction technique described herein uses multiple sections, brackets 159, and flanges, forming stationary frame 160 may entail providing a single piece having all the functionality described. In general, the materials used in assembly are required to support the frame, seat, and flywheel 110 and drive mechanism and enable the user or rider to pedal and effectuate the functionality discussed herein, and may differ from the assembly pictured.

FIG. 2 illustrates the construction of the present design's frame 160 or frame assembly, involving multiple frame tubing elements of formed steel, e.g. bottom bracket assembly, seat support structure 150, and foot support structure 120, dropouts 111 to support the flywheel and friction resistance pad mounting structure 113. Tubing elements 160 are typically attached by gluing or welding seams formed where two or more tubing elements are brought together to form frame 160 or other means sufficient to secure tubing elements of the frame when mated in accordance with the present design.

The seat support structure 150 contains the seat post and supports the seat 140 and connects to the adjustable sliding bracket 159. The bottom bracket shell is connected to the main support tube and the main support tube is connected to main tube 130, the chain stays 121 run parallel to the chain and connects the main tube to the front dropouts 111. The tube terminology used to describe the construction of the present design should be well understood by those skilled in the art.

The present design may attach the driveline assembly to frame 160. The drive-line assembly may support the pedal sub-assembly and provide a place to position the hands. The driveline assembly may comprise a pedal 161 and flywheel 110 arrangement. The pedal sub-assembly may include pedals 161 to provide the user a place to position his hands, a crank-arm 164 to attach the pedals to a chain-ring 163 and a bottom bracket bearing component and may connect a first crank-arm 164 to a second crank-arm component. The flywheel sub-assembly may include a freewheel 112 securely mounted and attached to flywheel. The fixed, i.e. single, gear may optionally be replaced with a cluster of gears (e.g. cassette), with appropriate shifting mechanism components allowing the user to change the amount of spinning resistance experienced while pedaling.

A chain 114 or belt (not shown) component may transmit forces applied by the user spinning pedals from the pedal sub-assembly to the flywheel sub-assembly. The chain or belt component is typically configured to mate or connect a chain-ring component to the front fixed gear component by positioning the chain over the front chain-ring and over the fixed single gear, or optionally a cluster of gears, and affixing a key link (not shown) to form a single continuous chain loop, and such a design is generally known within the art. A cover 116 FIG. 5 atop the driveline assembly for purposes of protecting the user during operation and affording access to service the driveline components previously described may cover the chain, chain-ring, and fixed gear components. The present design may involve a free-wheel assembly 112 and 111 FIG. 3 or direct drive assembly (not shown) along with the chain, chain-ring 165, and associated chain-drive components within driveline assembly to operate or spin flywheel.

Figure 4:
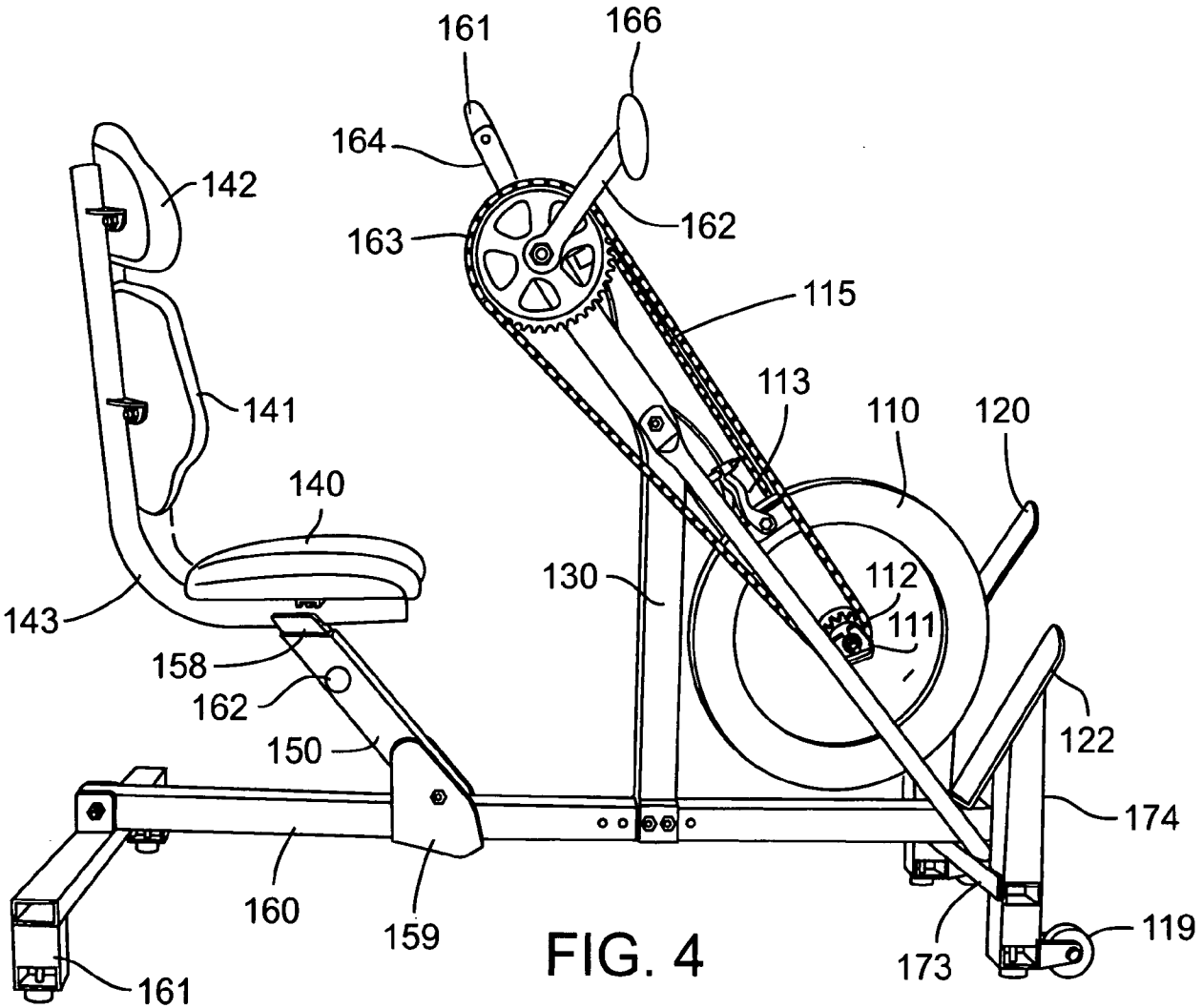
FIG. 4 is a right side view of the upper body spinning bike.

The present design may attach the drive unit assembly at the top of frame 160 main tube 130 as illustrated in FIG. 2. The drive unit assembly may support the bottom bracket 190, chain rings, crank arms and pedals allowing users a place to position their hands The present design may attach the seating assembly 140 behind the drive unit assembly located at the bottom frame element of frame 160 as illustrated in FIG. 2. The seating assembly may support seat, or saddle 140, and may provide users a place to position their body in accordance with the present design, while performing the simulated upper body spinning exercise. The seating assembly may include seat 140 fixed to seat post 150 sufficient to provide a sitting posture that may allow a user to properly position their body over frame 160. The seating assembly 143 may include a seat back assembly 142 and 141 as illustrated in FIG. 4. The seat back assembly may be connected to seat support tube 143 illustrated in FIG. 9 and may afford additional support for the rider's back and enable the rider to resist reactive force inputs generated in response to the resistance provided by the crank arms as the rider exerts force on the pedals to further accelerate the flywheel in accordance with one aspect of the present design. The seat back and seat assembly may be connected to lower main frame tube 158 and may include seat adjustment assembly 159 configured to enable the seat and back rest assembly to be moved toward or away from the drive unit assembly by means of a sliding engagement with lower main frame tube 160. The seat adjustment assembly may be constructed of plates and connecting bolt connected to main seat support tube 150. The adjustment assembly 159 is configured in such a manner that raising and rotating the seat and back assembly structure upwardly and forwardly releases the seat assembly and permits the seat and back rest assembly 143 to be moved either toward or away from the drive unit. After the seat assembly unit is adjusted to the preferred location the seat and back rest assembly is lowered back to the locked riding position. The seat and seat back assembly tube may be connected to telescoping tube 158 and telescoping tube is permitted to engage within main seat tube 150 in a telescoping manner such that the telescoping tube may be permitted to move collinearly within main seat tube to permit vertical adjustment of the seat and seat back assembly. A locking pin may 162 be used to secure the telescoping seat tube in position relative to main seat tube. A series of holes (not shown) may be located along the adjustment axis of telescoping seat tube 158 to enable locking pin 162 to engage respectively spaced holes and secure the seat tube in a locked position. The locking pin may be threaded and the main seat support tube may have a threaded sleeve (not shown) to permit the locking pin to be tightened against the sleeve and put pressure on the telescoping tube to prevent the tube from movement after the tube is locked in place.

The seating assembly and back rest may be used in combination with the drive unit assembly to assist the user in maintaining power delivery to the flywheel while spinning the pedals to perform the simulated upper body spinning exercise.

The present design may include a flywheel 110 attached to the brake stay tubes 121 in FIG. 2 at each side of the flywheel. The brake stays may include drop outs 111 attached to each brake stay tube at each side of the frame to receive the axle of the flywheel. The flywheel may be of substantial size with a substantial moment of inertia enabling the flywheel to maintain revolution against the friction device 113 and as powered by the operator to provide a smooth cycling experience for the operator.

The present design may include a friction device attached to the brake stays and may be configured to contact the flywheel and exert pressure against the flywheel resisting the rotation of the flywheel and configured to enable the operator to impede the rotation of the flywheel enabling the operator to increase or decrease the amount of exertion necessary to conduct the upper body spinning exercise. The friction device may include a variably adjustable tensioning device 115 configured to be actuated by the operator while using the upper body spinning exercise device. This will be clearly shown in FIG. 1.

The present design may include rollers 119 in FIG. 2 attached to the front of the frame configured to contact the floor when the rear of the frame is lifted off of the ground to facilitate moving of the upper body spinning exercise device.

FIG. 1 is a top view of the drive unit of the upper body spinning exercise device showing the bottom bracket assembly 190, chainrings 165 and 163, crank arms, pedals, tensioning device 115 and flywheel 110. These parts are well known to anyone schooled in the arts of bicycles or spinning bikes.

The present device may include a bottom bracket assembly attached to the main frame at the top of the main tube above the brake stay tubes. The bottom bracket device may include journaled bearings and matching shaft (not shown) configured to permit rotation of the shaft. In one embodiment of the present design the shaft may further be separated into two shafts (not shown) configured to be rotated independently of each other. In yet another embodiment of the present design the shaft 91 may be continuous FIG. 7. The shaft or shafts are supported on bearings journaled to permit rotation of the shaft when torque is applied to the crank arms by means of the hand pedals. There may be at least one chainring attached to at lease one of the shafts configured to rotate with at least one of the pedals and at least one of the shafts enabling the operator to turn the chainring by applying torque to at least one of the pedals. The chainring may be drivingly connected to the flywheel by means of belt or chain or configured to transmit torque and rotation from the chainrings to the flywheel resulting in rotation of the flywheel when one or more of the pedals are rotated by the operator's hands. The transmission of torque from the chainring to the flywheel is not limited by the means of torque and rotation transmission. For example the transmission of torque and rotation could be conducted by a drive shaft and ring gear. The drive unit may include two independent shafts cantilevered outward from the center of the bottom bracket on both sides of the bottom bracket. A chainring may be attached to each respective shaft and a crank arm and pedal may be attached to each chainring and shaft and each combination of chainring, crank arm, pedal and shaft configured to permit rotation of each grouping of chainring, crank arm, pedal and shaft independently of the other enabling the operator to pedal in an infinite variation of torque and rotation transmitting actions from the pedals to the flywheel.

Figure 3:
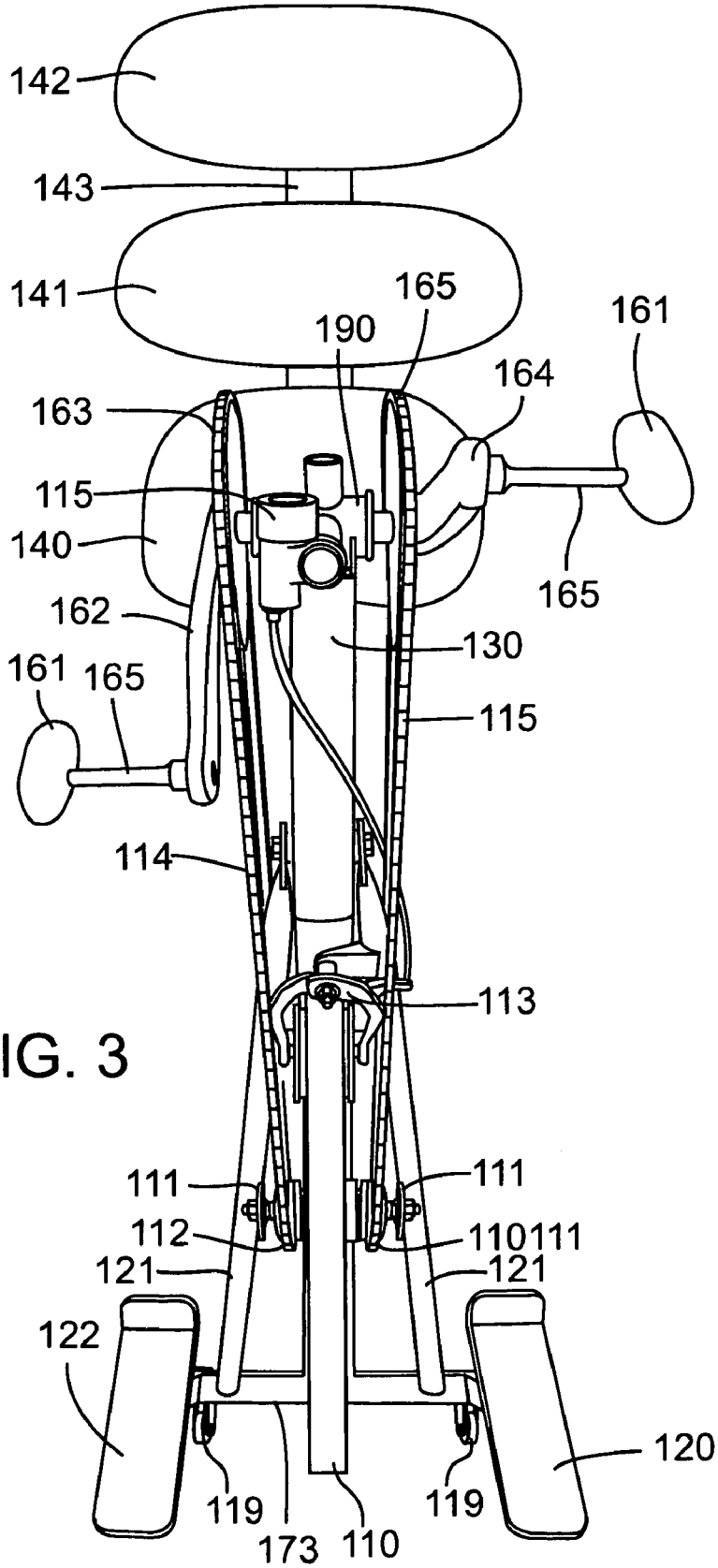
FIG. 3 is a top front view depicting the dual drive mechanism showing cantilevered, independently rotatable drive sprockets and crank arms connected by dual chains to a left-hand freewheel and a right hand freewheel imparting rotation to the flywheel; also shown are the footrests and adjustable resistance friction pads.

FIG. 3 shows the top view of the upper body spinning exercise device. The upper body spinning device may include a flywheel 110 configured to rotate about axle. Axle may be secured in dropouts at each side of the flywheel by lock nut and washer. The flywheel may include at least one sprocket 112 configured to interact with the chain or belt enabling the operator by means of pedaling the hand pedals to impart rotation to the flywheel. The use of sprockets, chains, flywheel, freewheels, crank arms and pedals would be well understood by anyone schooled in the art of bicycles and exercise bikes. In one embodiment of the present design the flywheel may include a freewheel 111 and 112 attached to each side of the flywheel and each freewheel configured to impart rotation to the flywheel enabling an endless chain to transmit rotation of the pedals through the chainring to the flywheel enabling the operator to spin the flywheel with his arms and hands and engage in an upper body spinning exercise. In this embodiment the operator may be able to pedal either pedal and rotate the flywheel or he may pedal both pedals and rotate the flywheel in any cadence or orientation that he chooses.

FIG. 4 shows a right side of the upper body exercise device with the crank arms and pedals in a 270 degree orientation relative to each other. FIG. 4 also shows the seat and seat back, the flywheel, main frame and footrests.

Figure 5:
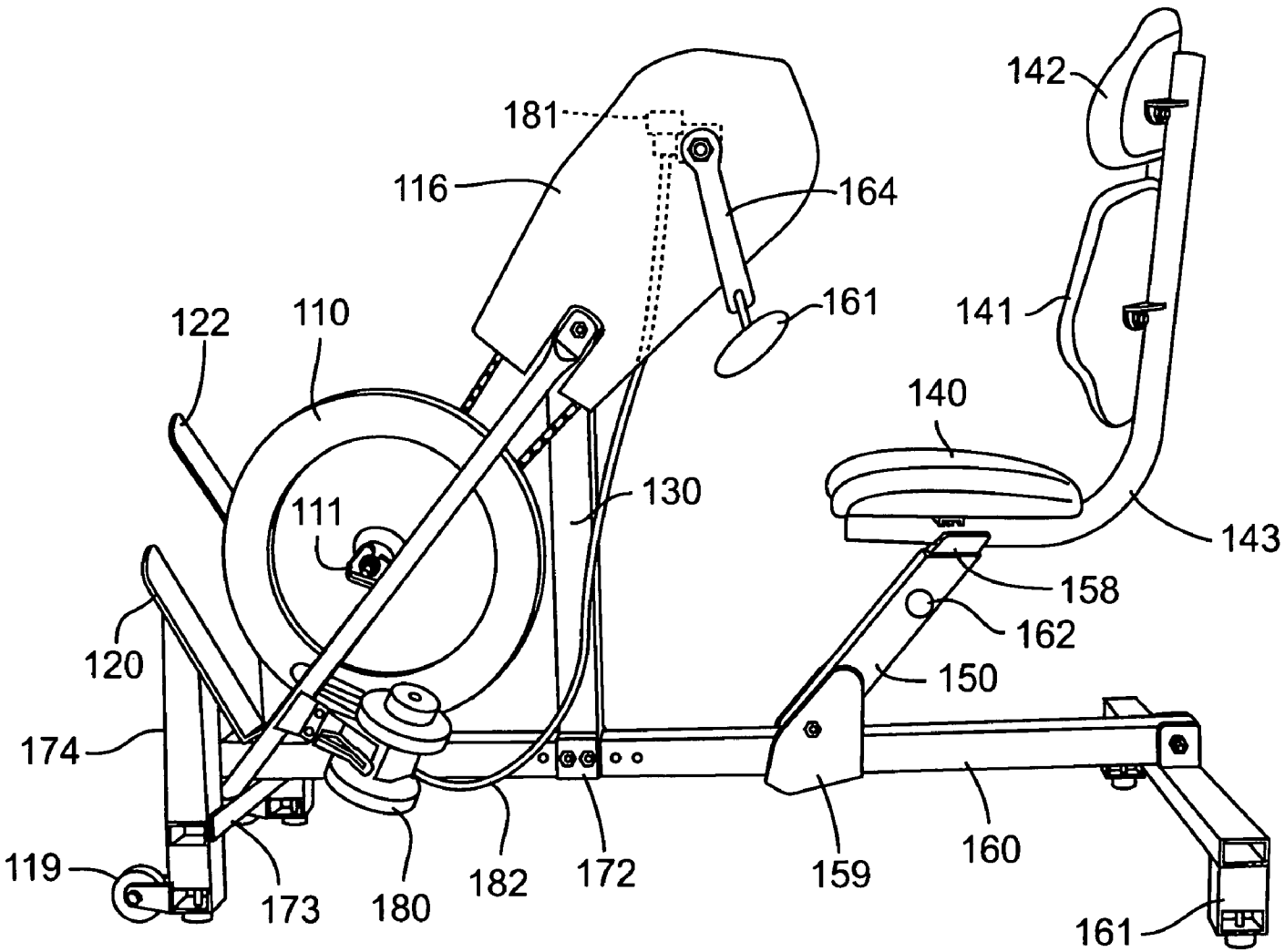
FIG. 5 depicts a left side view of the upper body spinning bike with the cranks shown in a tandem orientation relative to each other and showing the seat and showing foot rests

FIG. 5 shows a left side of the upper body exercise device. In one embodiment of the device the bike may include a single set of crank arms 162 configured to attach to the drive unit at the bottom bracket. The bottom bracket is as described above and includes a single rotatable shaft secured by journaled bearings within the bottom bracket (not shown). A chainring may be attached to the shaft and crank arms 162 and pedals 161 may be attached to the shaft and chainring and configured to impart rotation to the chainring when the pedals are rotated. The chainring may be configured to engage with an endless chain 115 or belt. The endless chain or belt may be configured to engage a sprocket and the sprocket may be drivingly connected to the flywheel 110 enabling the operator to impart a rotation of the flywheel by rotating the pedals with his hands and arms. Bicycle crank arms are well known by anyone schooled in the art of bicycles. The present design may include a chain guard 116 configured to enclose the chain or belt. The chain guard shown is a partial cover of the chain and is not intended to exemplify the preferred embodiment of chain or belt protection.

In one embodiment of the present design a magnetic resistance unit 180 may be attached to the frame and configured to contact the flywheel and further configured to resist rotation of the flywheel enabling the operator to increase of decrease the amount effort needed to execute the upper body spinning exercise. The magnetic resistance unit may be configured to enable variable resistance settings. The magnetic trainer may include a remote control device 181 configured to permit variation of the resistance settings by the operator while using the exercise bike enabling the user to match the resistance of the flywheel to the user's desired level of physical effort.

Figure 6:
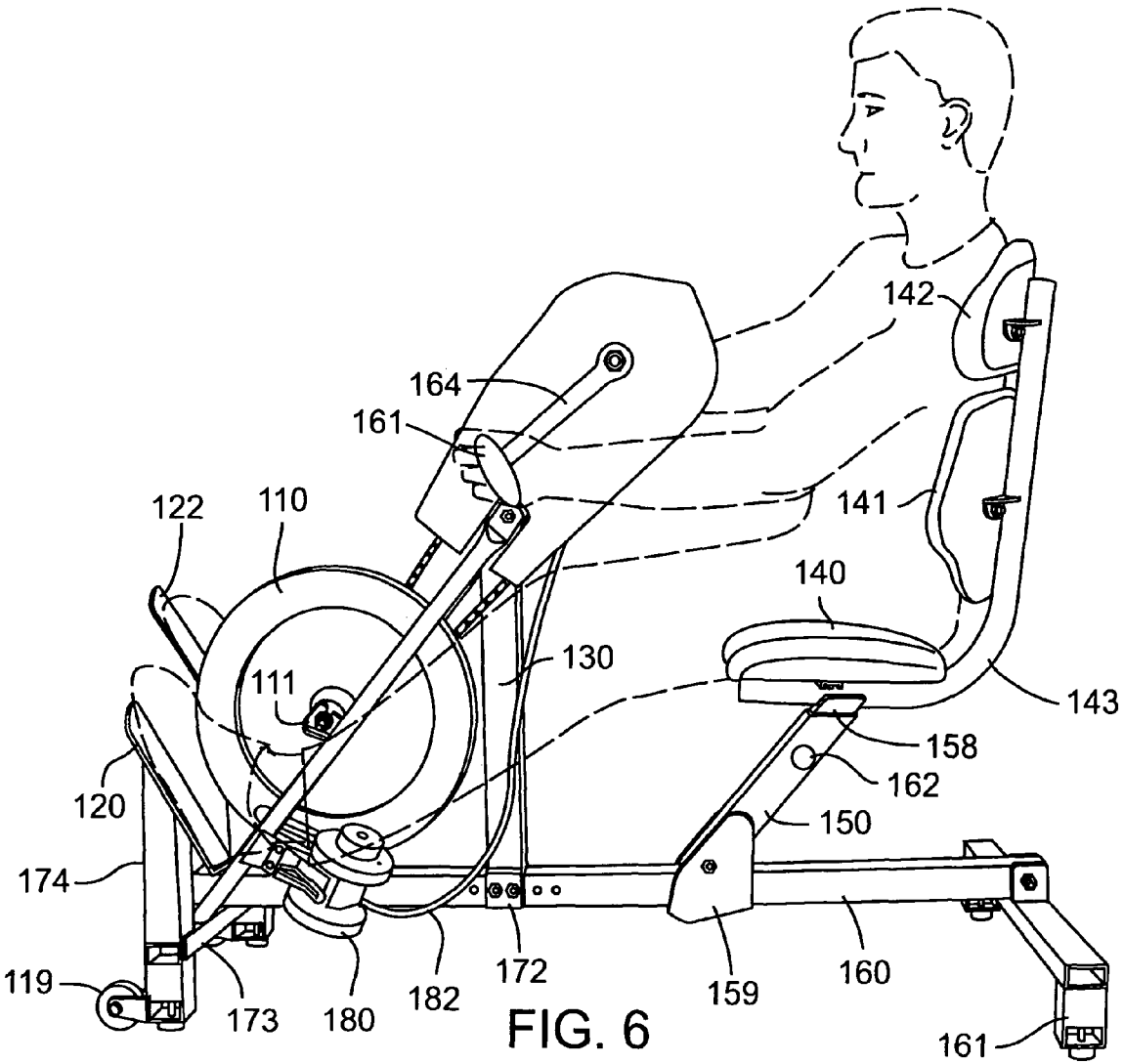
FIG. 6 depicts a rider shown on the upper-body spinning bike with the seat adjusted low and rearward and with the feet on footrests; the cranks are shown in the tandem position and as shown are not able to rotate independently of each other.

FIG. 6 is a left side view of the upper body spinning exercise device with the user seated low and rearward on the device. In one embodiment of the upper body spinning device the drive unit may include crank arms 164 often used on and associated with conventional bicycles. Pedals may be connected to shafts journaled to engage bearings (not shown) enabling the pedals to rotate freely relative to the shafts and the shafts may be engaged with the crank arms with male threaded ends engaged in female threads in the crank arms (not shown). In one embodiment of the present device the crank arms may be in fixed orientation relative to each other and directly engaged by chain or belt with the flywheel by engagement of the drive chain or belt with a fixed sprocket or a freewheel hub configured to impart rotation to the flywheel when the user applies force to the pedals with his hands and arms.

Figure 7:
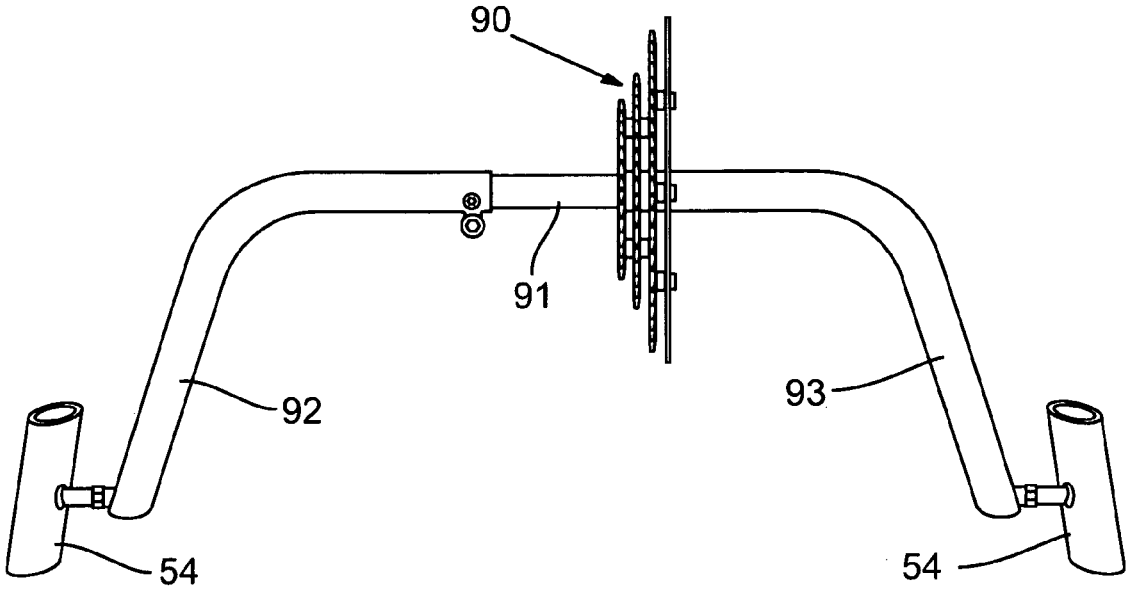
FIG. 7 depicts the wide cranks shown with the drive sprocket assembly, hand pedals and bearing area on shaft.

FIG. 7 shows a pair of wide cranks arms configured with chainrings 90 and pedals 54 and shaft 91. In one embodiment of the present design the apparatus may include wide hand crank arms 93 and 92 rotatingly engaged with the bottom bracket assembly bearings. The wide crank arms may extend outwardly from the center of the upper body exercise device. This type of wide crank arms is well known to anyone schooled in the art of handcycles and they are referred to as "wide cranks" among hand cyclists. The pedals at the distal ends of the wide cranks may be thirteen inches or more from the central forward—aft axis of the exercise bike and may be nine inches in length from the axis of the bottom bracket shaft to the axis of the hand pedal. The present design is not limited to a particular length or width of crank arm but will be appreciated that the operator is able to exercise different muscles of the upper body by altering the width of the pedals and the length of the offset from the bottom bracket shaft to the pedal shaft. It will be appreciated that the wide cranks may be pedaled either in tandem or opposed further enabling the user to exercise different muscle groups. The wide crank arms may be configured to receive bearings (not shown) at their distal ends and the pedals may include a shaft (not shown) enabling the pedals to be rotatingly attached to the bearings and enabling the operator to spin the crank arms and maintain a relatively fixed orientation of the hand pedals in space as the crank arms are rotated.

Figure 8:
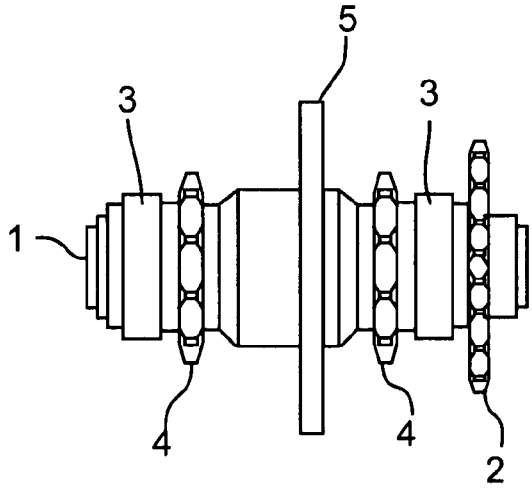
FIG. 8 shows a jackshaft configured for means to allow independent rotation of each side crank arm and showing sprockets with integral roller clutches, driven shaft and final drive gear for transferring rotation to the flywheel. Roller clutches are shown with reversed orientation providing both left and right hand drive to the drive shaft. This allows one clutch to remain stationary and still allow the drive shaft to rotate while the other clutch drives the drive shaft and vice-versa.

FIG. 8 shows a device for enabling the independent rotation of the crank arms relative to each other when the pedals are engaged by the rider and rotation is imparted by chain or belt to the flywheel. In one embodiment of the present design the drive unit may include a shaft 1, sprockets, roller clutches 3 and 4 and drive sprocket 2. A flange bearing 5 is journaled to accept the drive shaft and the flange bearing is configured to attach to the main frame (attachment not shown) at some distance from the bottom bracket and hand crank arms. A left hand drive 3 and a right hand drive 4 roller clutch are configured to engage the drive shaft and impart rotation the drive shaft 1. The crank arms may be configured as above such that the drive shafts are cantilevered about the central axis of the apparatus at the bottom bracket (not shown) and each drive shaft is configured with a sprocket, crank arm and pedal as shown if FIG. 1 and each sprocket and crank arm are drivingly connected to respective left or right hand roller clutches by chain or belt and enable the rotation of either crank arm and sprocket to impart rotation to the respective roller clutches and engage the drive shaft and drive sprocket 2 and by means of chain or belt impart rotation to the flywheel. It will be appreciated that either crank arm may impart rotation singularly or in conjunction with the other crank arm. It will further be appreciated that the drive sprocket and drive shaft may rotate in either direction forwardly or rearward but may be driven only forwardly by the respective roller clutches.

Figure 9:
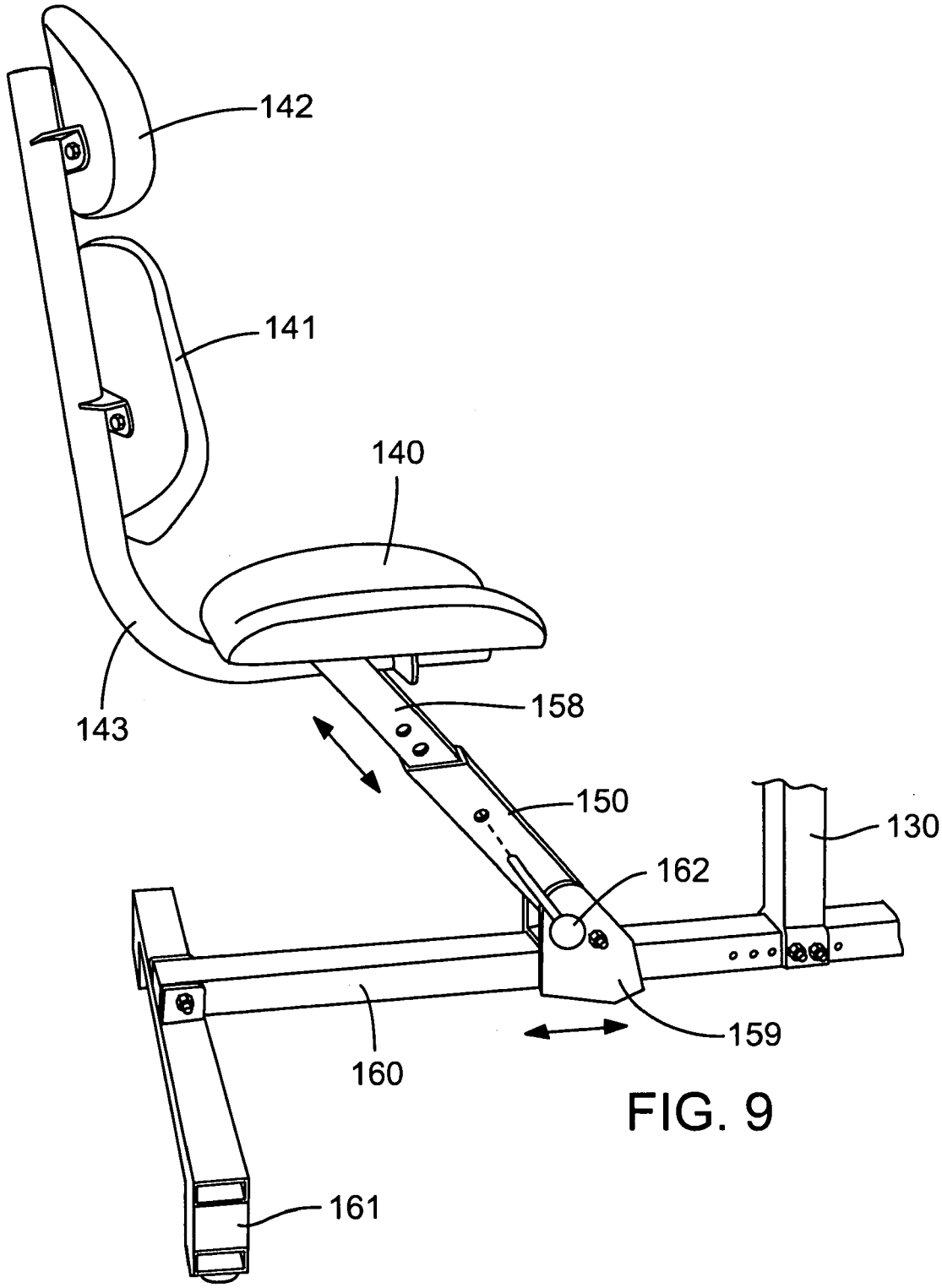
FIG. 9 is a right side view showing the vertical seat adjustment and locking pin as well as the horizontal sliding mechanism for adjusting the seat and locking in seat in place horizontally.

FIG. 9 shows a right side of one embodiment of the present design with adjustable seat position. In one embodiment of the present design the upper body exercise device may include a seat bottom and seat back configured for vertical and horizontal adjustment. The seat may be configured to move horizontally toward or away from the crank arms or diagonally, vertically and horizontally up and away from the crank arms or down and towards the crank arms. It will be appreciated that there may be many means of adjustment of the seat and seat back position that would be considered part of the present design or the bottom bracket and cranks may be moved vertically or horizontally toward a stationary seat. Both embodiments may be part of the present design.

Figure 10:
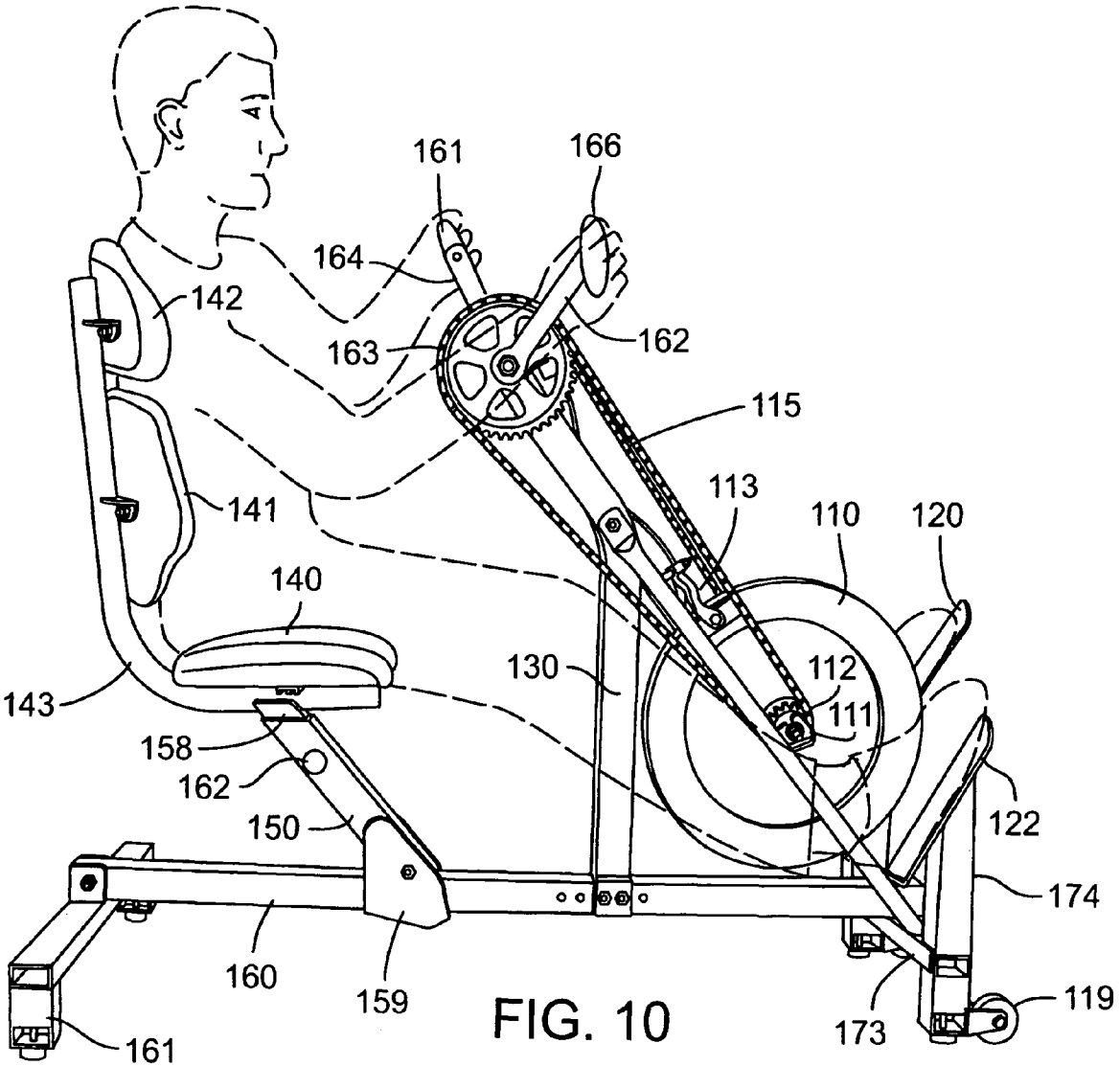
FIG. 10 is a side view showing the rider on the upper body exercise cycle showing the seat adjusted to the rider's body size and the rider's feet on footrests and the crank arms are shown in a 90 degree orientation to each other.

FIG. 10 shows a right side one embodiment of the present design with a rider seated on the bike with his feet resting on the foot rests and his hands engaging the crank arms at a 270 degree orientation to each other.

Figure 11:
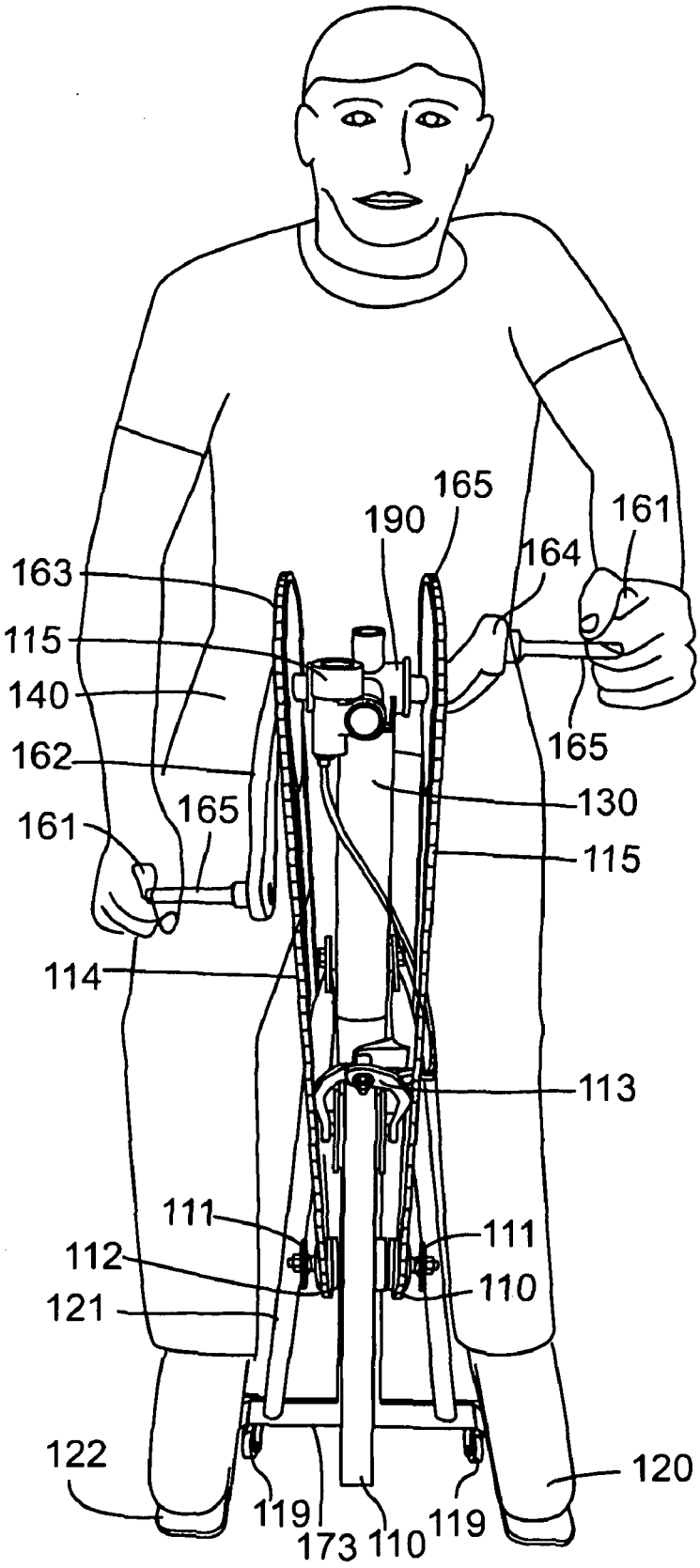
FIG. 11 is a front view of rider on the upper body exercise cycle showing the crank arms in the 180 degree opposed position.

FIG. 11 is a front on view of the upper body spinning bike exercise device with the crank arms in an opposed position and the rider seated high and close to the crank arms. It will be appreciated that any seating position and crank arm orientation that engages the user comfortably with the crank arms and permits a comfortable operation of the upper body exercise device would fall within the present scope of the upper body spinning exercise device.

Figure 12:
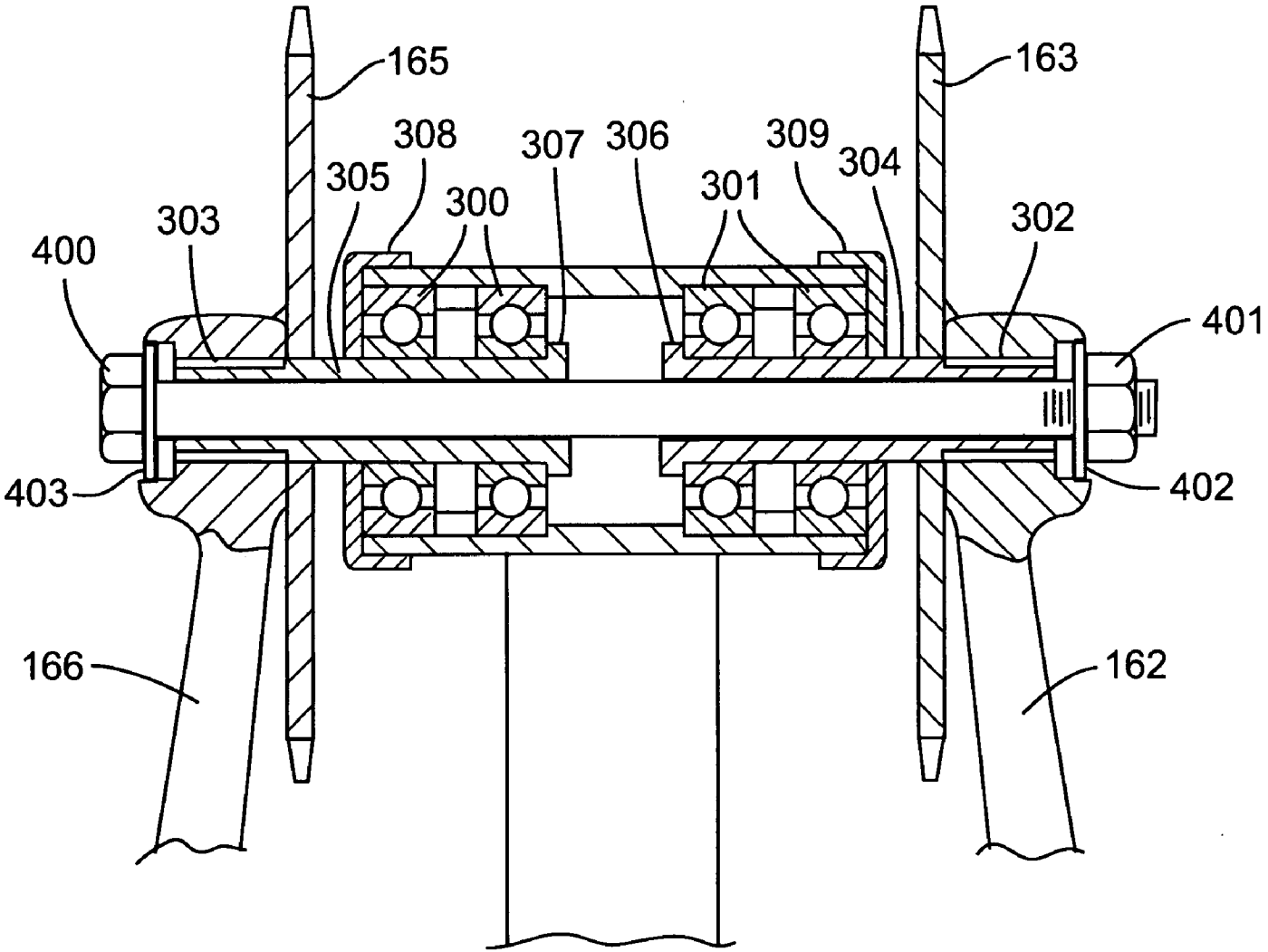
FIG. 12 is a view of the drive unit.

FIG. 12 shows the bottom bracket assembly in one embodiment of the present design. Bearings 300 and 301 are shown on left and right sides of the bottom bracket shell 190. Crank arms 162 and 166 are fixedly attached to chainrings 163 and 165 which are in turn fixedly connected by means of splined ends 302 and 303 to distal ends of splined shafts 304 and 305 respectively. It will be appreciated that rotation of crank arms 162 and 166 cause rotation of shafts 304 and 305 within bearings 301 and 300 respectively. Bearings 300 and 301 are secured in place by end caps 308 and 307 respectively. Outward movement of shafts 304 and 305 are prohibited by shoulders 306 and 307 respectively seating against inner faces of bearings 301 and 300 respectively. Through bolt 400 passes through shafts 304 and 305 respectively and is loosely secured within bearing assemblies 300 and 301 by locking nut 401 and washers 402 and 403. It will be appreciated that through bolt 400 fits closely with the inner bore of shafts 304 and 305 in such a manner that permits rotation of shafts 304 and 305 relative to through bolt 400. Bolt 400 acts to minimize flexing of itself and shafts 304 and 305 about their common axis and thus acts to resist wobbling of chainrings 163 and 165 when torque is applied to crank arms 162 and 166. It will be further appreciated that the above arrangements of bearings 300 and 301 and shafts 304 and 305 permit independent rotation of cranks arms 162 and 166 and chainrings 163 and 165 to enable independent engagement of either crank arm with flywheel 110.

Operation

FIG. 10 is a side view of the upper body exercise spinning device with the rider seated in the seat with his back against the seat back and the seat adjusted to permit a comfortable bend in the knees while the user's feet are resting on foot rests. The rider's hands and arms are extended forward and the rider hands are engaged with the pedals at each side of the bottom bracket. The seat and seat back are positioned such that the crank arms are mid chest and the arms are slightly bent.

Thus in operation, a user may employ the present design by first adjusting the seat and seat back to a comfortable position. The user will then make a choice between wide crank arms or narrow crank arms, fixed crank arms or independent crank arms and long or short crank arms. The user will begin spinning the flywheel by engaging the hand pedals with his hands and rotating the crank arms. If the rider has chosen to ride the exercise device with fixed crank arms then he will decide on an orientation; side by side, opposed, or some angular orientation that bests suits the muscle group that the user desires to exercise at the time. The rider spins the flywheel with the respective crank orientation and adjusts the tensioning device to the desired resistance. The spinning flywheel acts to maintain motion of the crank arms and creates a smooth continuity to the spinning experience. The rider will continue to rotate the crank arms either rapidly or slowly depending on the resistance and the desired effect of the exercise; and exercise favoring strength conditioning of the upper body will favor a slow, strong and steady and rotation of the crank arms and a cardiovascular exercise will favor a rapid rotation of the crank arms against minimal resistance depending on the rider's physical condition. Riding with the wide crank arms will exercise the outer pectoral muscles and upper back and traps while riding with the narrower crank arms will exercise the biceps, deltoids and triceps.

The user engaged in the operation of the upper body spinning bike in another embodiment of the present design would select a drive unit with cranks that are independently engaged with the flywheel. The user may use this configuration in a spinning class setting along with stationary bikes configured to be ridden with the user's legs. The user would pedal with one arm and then the other in varying orientations and motions; sometimes rapidly with one arm while slower with the other or both rapidly or with the pedals opposed and then in tandem switching back and forth and sometimes to the accompaniment of music or under the direction of the instructor. The rider then may switch from the upper body spinning device to a stationary spinning bike and continue exercising on the stationary spinning bike configured to exercise the legs in the class setting.

The user will ride the upper body exerciser bike for some period of time depending on his physical condition for twenty minutes to more than an hour with a typical spinning class lasting forty minutes to and hour.

The design presented herein and the specific aspects illustrated are meant not to be limiting, but may include alternate components while still incorporating the teachings and benefits of the invention, namely an upper body spinning exercise apparatus enabling an upper body muscle and cardiovascular exercise involving the rotation of crank arms in varying rotational orientation and varying widths engaged with a flywheel and pedaled against an adjustable resistance to enable an upper body spinning bike experience. While the invention has thus been described in connection with specific embodiments thereof, it will be understood that the invention is capable of further modifications. This application is intended to cover any variations, uses or adaptations of the invention following, in general, the principles of the invention, and including such departures from the present disclosure as come within known and customary practice within the art to which the invention pertains.

The invention claimed is:

1. A method for enabling a user to perform an upper body spinning exercise, comprising:

providing a frame and;

providing a wheel and;

providing a drive unit cooperatively connected to said wheel and;

employing a pair of crank arms associated with the drive unit, said crank arms operatively associated with said wheel and;

providing a hand pedal associated with each said crank arm and;

said hand pedal enabling the user to employ crank arms configured to receive force from and to be engaged by operator's hand and;

providing each crank arm configured to impart rotation to the wheel and;

providing each crank arm configured to impart rotation to the wheel independent of the other crank arm and without either crank arm imparting rotation to the other crank arm and hand pedal;

wherein the user causes at least one crank arm to impart rotation to the wheel whereby the user's upper body and arms are exercised.

2. The method of claim 1, further comprising the user employing said crank arms and hand pedals configured to receive force from the user and configured to rotate in either direction imparting rotation to the wheel in only the forward direction.

3. The method of claim 1, further comprising the user engaging the hand pedals and participating in an upper body spinning class.

4. The method of claim 1, further comprising the user employing said crank arms and hand pedals disposed widely or crank arms and hand pedals disposed narrowly on the frame to provide a wide grip or a narrow grip to exercise a wide range of muscles.

5. The method of claim 3 further comprising the user engaging either crank arm to the accompaniment of music.

6. The method of claim 3 further comprising the user engaging either crank arm to participate in a class setting under the direction of an instructor.

7. A method for enabling a user to perform an upper body spinning exercise, comprising:

providing a frame and;

providing a wheel and;

providing a drive unit cooperatively connected to said wheel and;

employing a seat connected to the frame enabling the operator to support the operator's trunk and;

employing a structure enabling the operator to support the operator's foot and;

employing a pair of crank arms associated with the drive unit, said crank arms operatively associated with said wheel and;

providing a hand pedal associated with each said crank arm and;

said hand pedal enabling the user to employ crank arms configured to receive force from the operator's hand and;

providing each crank arm configured to impart rotation to the wheel independent of the other crank arm and without either crank arm imparting rotation to the other crank arm and hand pedal;

wherein the user causes at least one crank arm to impart rotation to the wheel whereby the user's upper body and arms are exercised.

8. The method of claim 7, further comprising the user employing said crank arms and hand pedals configured to receive force from the user and configured to rotate in either direction imparting rotation to the wheel in only the forward direction.

9. The method of claim 7, further comprising the user engaging the hand pedals and participating in an upper body spinning class.

10. The method of claim 9, further comprising the user employing said crank arms and hand pedals disposed widely or crank arms and hand pedals disposed narrowly on the frame to provide a wide grip or a narrow grip to exercise a wide range of muscles.

11. The method of claim 7 further comprising the user engaging either crank arm to the accompaniment of music.

12. The method of claim 7 further comprising the user engaging either crank arm to participate in a class setting under the direction of an instructor.

* * * * *